US010249932B1

(12) United States Patent
Burrell et al.

(10) Patent No.: US 10,249,932 B1
(45) Date of Patent: Apr. 2, 2019

(54) BOLLARD LIGHTING FIXTURE WITH INTEGRATED ANTENNA

(71) Applicant: TESSCO Communications Incorporated, Hunt Valley, MD (US)

(72) Inventors: Dennis Burrell, Austin, TX (US); Ajay Francis, Laurel, MD (US)

(73) Assignee: TESSCO Communications Incorporated, Hunt Valley, MD (US)

( * ) Notice: Subject to any disclaimer, the term of this patent is extended or adjusted under 35 U.S.C. 154(b) by 0 days.

(21) Appl. No.: 15/017,122

(22) Filed: Feb. 5, 2016

(51) Int. Cl.

| | |
|---|---|
| ***H01Q 1/22*** | (2006.01) |
| ***H01Q 1/44*** | (2006.01) |
| ***H01Q 21/20*** | (2006.01) |
| ***F21S 8/08*** | (2006.01) |
| ***F21V 15/01*** | (2006.01) |

(52) U.S. Cl.
CPC ..... *H01Q 1/22* (2013.01); *F21S 8/083* (2013.01); *F21V 15/01* (2013.01); *H01Q 1/44* (2013.01); *H01Q 21/205* (2013.01); *H01Q 1/2291* (2013.01)

(58) Field of Classification Search
CPC ..... H01Q 1/44; H01Q 1/246; H01Q 1/22; H01Q 1/42; H01Q 21/205; H01Q 1/2291; F21V 15/01; F21S 8/083
See application file for complete search history.

(56) References Cited

U.S. PATENT DOCUMENTS

| | | | | |
|---|---|---|---|---|
| 5,757,324 | A | 5/1998 | Helms et al. | |
| 6,222,503 | B1 | 4/2001 | Gietema et al. | |
| 6,388,622 | B1 | 5/2002 | Jennetti et al. | |
| 7,036,734 | B2 | 5/2006 | Baker | |
| 8,203,501 | B2 | 6/2012 | Kim | |
| 8,416,059 | B1 | 4/2013 | Rambadt et al. | |
| 8,836,607 | B2 | 9/2014 | Cook | |
| 9,726,360 | B1 * | 8/2017 | Alexander | F21V 23/06 |
| 2004/0219924 | A1 | 11/2004 | Flynn | |
| 2010/0237798 | A1 * | 9/2010 | Wolf | H05B 37/0263 315/294 |
| 2012/0143383 | A1 | 6/2012 | Cooperrider et al. | |
| 2014/0240193 | A1 | 8/2014 | Caldwell et al. | |
| 2015/0002361 | A1 * | 1/2015 | Pu | H01Q 1/246 343/853 |
| 2015/0035704 | A1 | 2/2015 | Schwengler et al. | |
| 2017/0030538 | A1 * | 2/2017 | Geisler | F21S 8/083 |
| 2017/0038018 | A1 * | 2/2017 | Johnson | H05B 37/0227 |

FOREIGN PATENT DOCUMENTS

| | | | |
|---|---|---|---|
| CN | 2779630 | Y | 5/2006 |
| CN | 202050047 | U | 11/2011 |
| JP | 2008211391 | A | 9/2008 |
| WO | WO 2014199089 | A1 | 12/2014 |

* cited by examiner

*Primary Examiner* — Hai V Tran
*Assistant Examiner* — Michael M Bouizza
(74) *Attorney, Agent, or Firm* — Shlesinger, Arkwright & Garvey LLP

(57) ABSTRACT

A bollard light fixture comprises a housing including a longitudinal, vertical hollow portion; and a plurality of directional antennas disposed within the vertical hollow portion, the antennas are configured to radiate RF signals outwardly from inside the housing and receive RF signals.

13 Claims, 8 Drawing Sheets

| | |
|---|---|
| Type | Farfield |
| Approximation | enabled (kR>> 1) |
| Monitor | farfield (f=5.85) [1[1,0]+2[1,0]+3[1,0]+4[1,0] |
| Component | Abs |
| Output | Realized Gain |
| Frequency | 5.85 |
| Rad. effic. | -0.3122 dB |
| Tot. effic. | -0.8756 dB |
| rlzd. Gain | 3.954 dB |

BOLLARD LIGHTING FIXTURE WITH INTEGRATED ANTENNA

FIELD OF THE INVENTION

The present invention is generally directed to integrating antennas within the structure/housing of a bollard lighting fixture in order to provide various methods of RF propagation from a communication system.

BACKGROUND OF THE INVENTION

Bollard lights are a type of architectural outdoor lighting fixture comprising short, upright ground-mounted units, typically giving off light from the top or the sides, and used to illuminate walkways, steps or pathways. With the proliferation of wireless communications, users of smartphones, laptops, tablets, etc. want to be connected everywhere—even walkways, steps and pathways.

The present invention provides wireless communication in areas along walkways, steps or pathways where bollard lighting fixtures are installed.

SUMMARY OF THE INVENTION

The present invention provides a bollard light fixture comprising a housing including a vertical hollow portion; and a plurality of directional antennas disposed within the vertical hollow portion, the antennas are configured to radiate RF signals outwardly from inside the housing and receive RF signals.

DETAILED DESCRIPTION OF THE INVENTION

Figure 1:
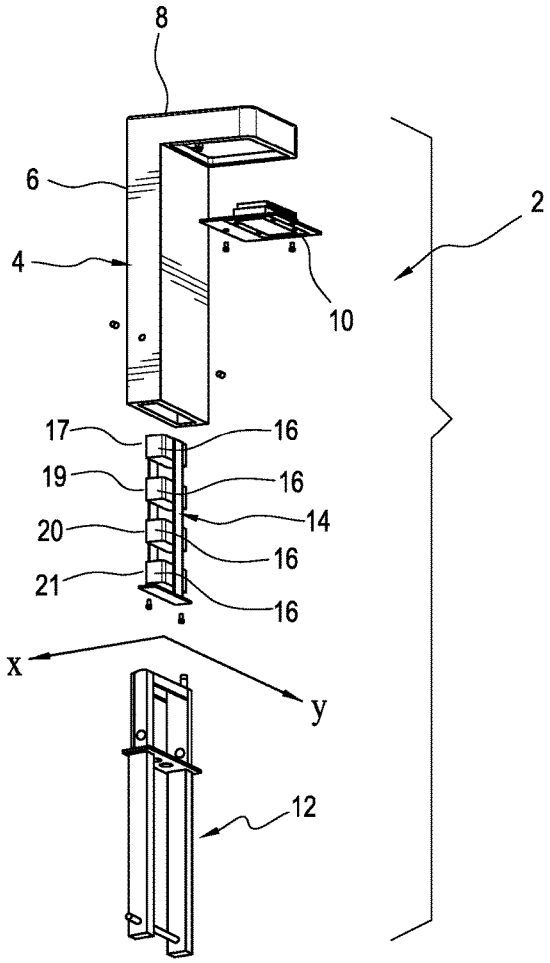
FIG. 1 is an assembly view of a bollard light fixture incorporating the present invention.

A bollard light fixture 2 embodying the present invention is disclosed in assembly view in FIG. 1. The light fixture 2 is generally around 30 inches tall, and is generally used to light walkways, pathways, landscaping, etc. The light fixture 2 includes a hollow vertical housing 4 with a vertical portion 6 and an upper portion 8. A light source 10, typically from a light bulb or LED, disposed in the upper portion 8 to project light downwardly onto a walking surface, such as a walkway. A suitable support 12 cemented into the ground is used to hold the light fixture 2 in the upright position.

An antenna system 14 is disposed inside the vertical portion 6 of the housing 4 in accordance with the present invention. The antenna system 14 is configured to propagate the RF signal from the antennas to the client device (user device) and to receive a RF signal from the client device. The antenna system 14 connects to a radio that provides the wireless signal via coaxial cables. The housing 4 is made of material that allows the antennas RF radiation to exit or enter the bollard light fixture 2 and houses the antenna system 14. Examples of such material are plastic, polycarbonate, concrete without rebar's, etc.

While the bollard light fixture 2 is shown with an inverted L-shaped housing, it should be understood that a bollard light fixture may have other shapes, such as cylindrical, with the light exiting radially at the top. For example, an internet search for "bollard light fixtures" yielded images of bollard light fixtures of various shapes. For the present invention, the shape of the bollard light fixture is not important as long as there is vertical room inside the housing in which to dispose the antenna system 14.

The antenna system 14 has four vertical levels 17, 19, 20 and 21, each level being disposed one above the other in a vertical fashion. Each level has four antennas 16. Each antenna 16 is a directional antenna and is disposed to face a specific direction so that all four antennas in the same level working together will radiate in all directions. Each antenna 16 faces a respective direction in the X and Y-axes. For a housing that has four vertical walls that define a rectangular cross-section, each of the four antennas 16 at a respective level is oriented to face a respective one of the four vertical walls. For a non-rectangular cross-sectional shape of a housing, each antenna 16 is directed toward the respective four directions of the X- and Y-axes. The four antennas 16 on each level face the respective four directions of the X- and Y-axes and function as an omnidirectional antenna to provide coverage in all directions. With the four levels 17, 19, 20 and 21, the antenna system 14 is configured to have four omnidirectional antennas disposed vertically in series above one another. A carrier is provided, as will be described below, that positions each individual antenna 16 vertically and horizontally.

The antenna system 14 is used for a four-port access point. Each level of the antenna system 14 provides omnidirectional radiation pattern that surrounds the bollard light fixture 2 such that a client device will receive wireless signal within the range of the bollard light fixture 2.

Figure 2:
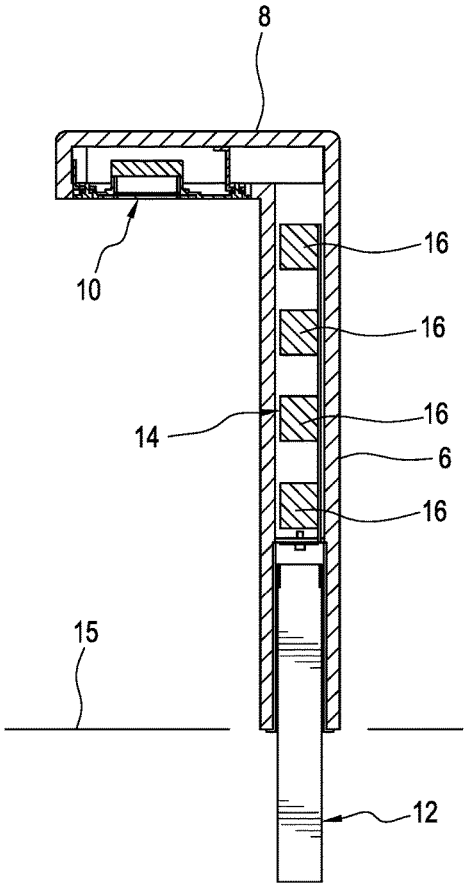
FIG. 2 is a cross-sectional view of the bollard light fixture shown in FIG. 1.

Referring to FIG. 2, the light fixture 2 is shown in cross-section and installed in the ground 15 along a sidewalk, pathway, landscaping, etc. to provide lighting. The vertical portion 6 of the housing 4 has sufficient width and depth to receive the antenna system 14 within its interior space.

Figure 4:
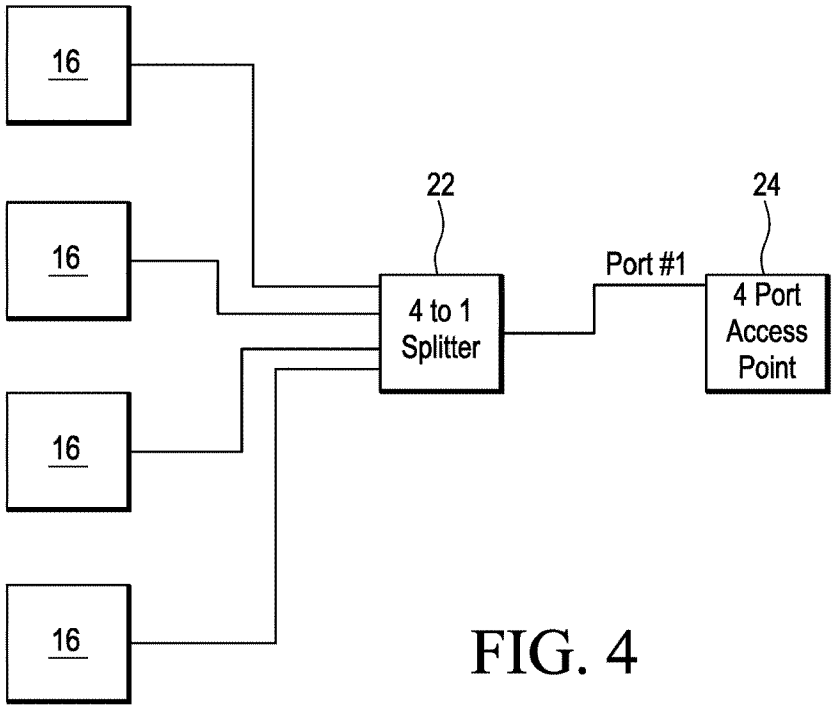
FIG. 4 is a schematic view of a connection of the four antennas shown in FIG. 3.
Figure 3:
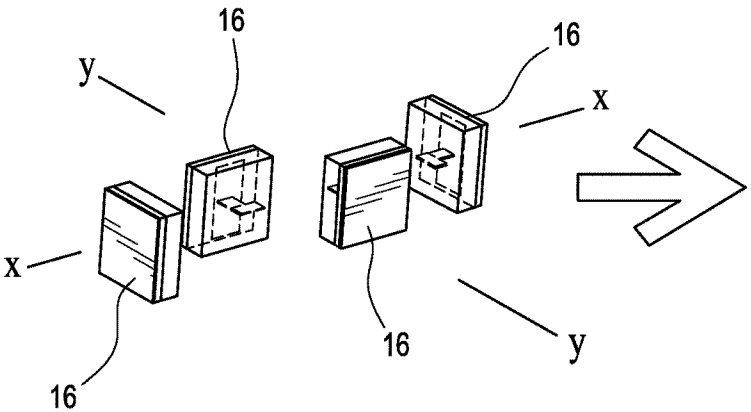
FIG. 3 is a perspective schematic view of four antennas arranged to face a respective direction in the X- and Y-axes.

Referring to FIGS. 3 and 4, one level of the antenna system 14 is shown and is identical to the other levels. Each antenna 16 is configured to face a respective direction in the X- and Y-axes. Each antenna 16 in each level is connected via co-axial cables to a four-to-one splitter 22 to provide one output, which is then connected to one port in a 4-port access point (radio) 24. This configuration produces a quasi-omnidirectional pattern (see FIG. 5) for each level. The other levels of the antenna system 14 are identical to FIG. 3. The four antennas 16 in each level are connected to a dedicated splitter 22, which is connected to a vacant port of the access point 24. Accordingly, the antenna system 14 has 16 antennas, 4 four-to-one splitters 22 and one 4-port access point 24. The antenna system 14 provides a quasi-omnidirectional configuration that allows for greater isolation between the four ports of the access point. Other antenna configuration may include 12 or 24 antennas.

Figure 5:
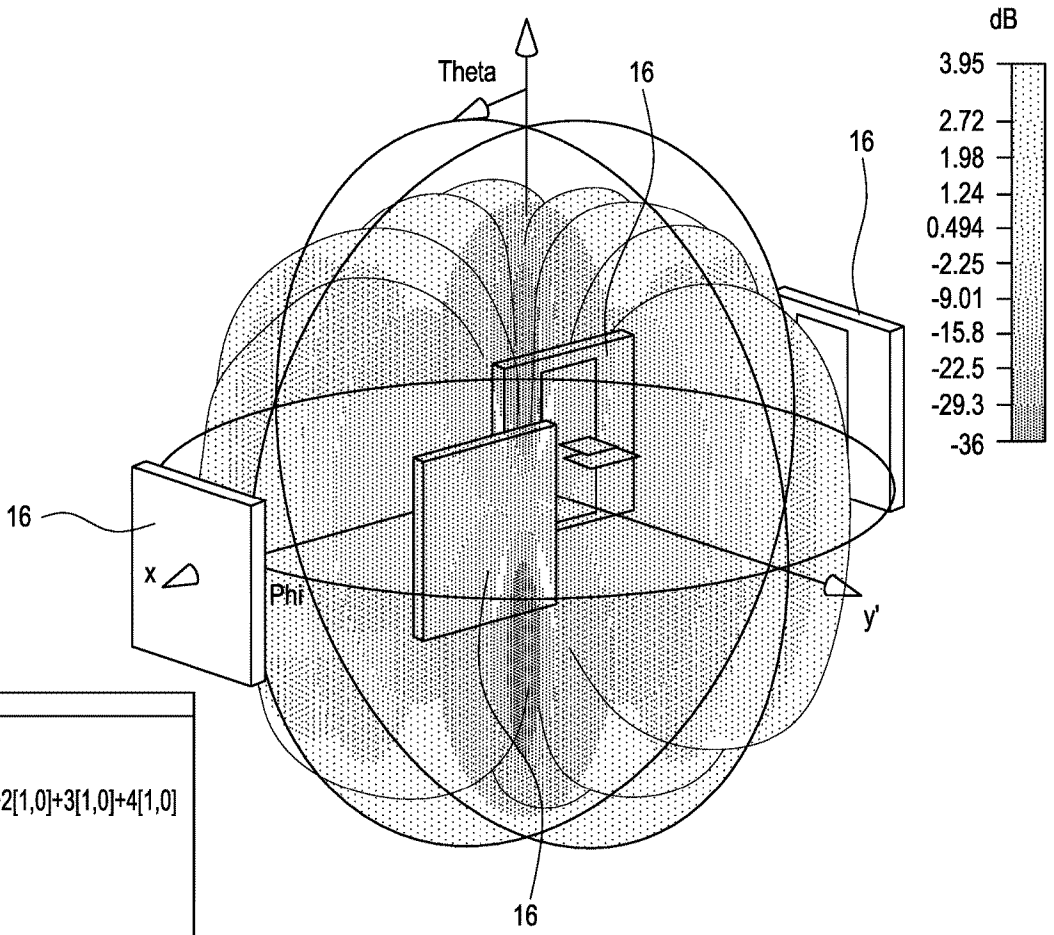
FIG. 5 a simulated radiation pattern of the four antennas shown in FIG. 3.

Referring to FIG. 5, a simulated radiation pattern is shown for the four directional antennas 16 shown in FIG. 3 for one level of the antenna system 14. The antennas 16 are connected together to form a quasi-omnidirectional pattern at a frequency of 5.85 GHz. The radiation pattern is repeated for each of other levels of the antenna system 14 when connected to the access point (radio) 24.

The antenna system 14 propagates the RF signal from the client (user device) and to receive a RF signal from the client device. The antenna system 14 connects to a radio (not shown) that provides the wireless signal via coaxial cables. The number of connectors attached to the antennas (radiating elements) 16 depends on the type of wireless radio being used as well as the type of antenna being used—directional or directional antennas configured to provide a quasi-omnidirectional pattern. For a directional antenna, there are typically 3, 4 or 6 cables. For an omnidirectional antenna, there will be 12, 16 or 24 antennas.

Although four levels of antennas are shown, the number of levels may be different depending on the coverage required in a specific installation.

Figure 6:
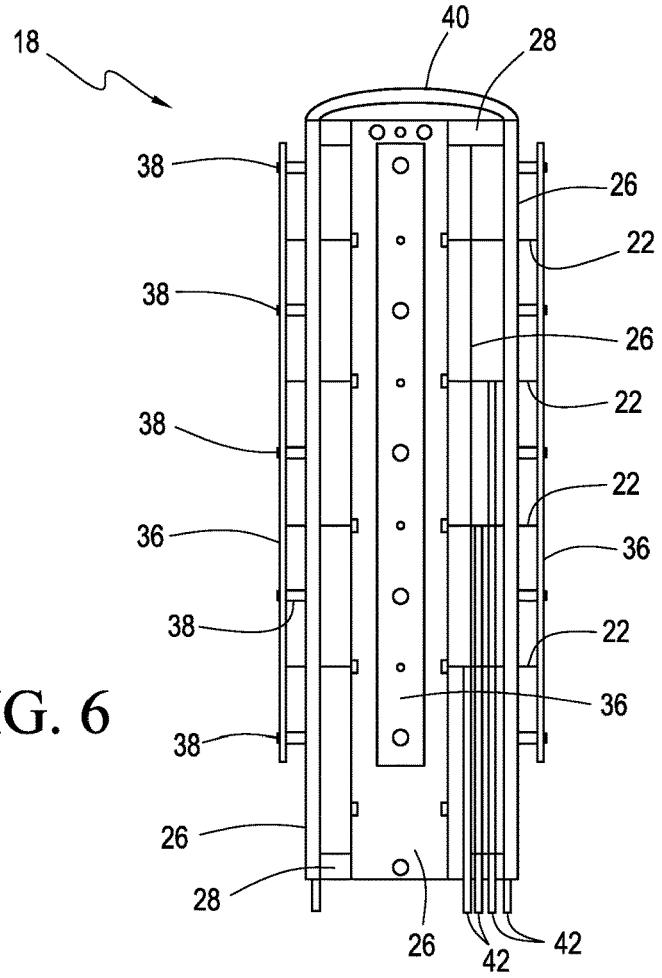
FIG. 6 is a side elevational view of an omnidirectional antenna system on a carrier.
Figure 7:
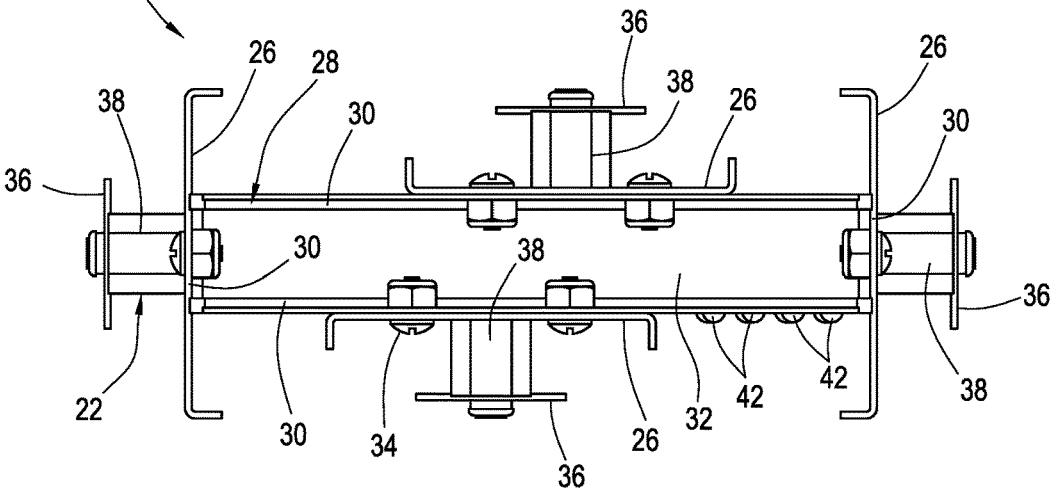
FIG. 7 is a bottom view of FIG. 6.

Referring to FIGS. 6 and 7, a carrier 18 is provided to which the antennas 16 are attached to position the antennas 16 in space vertically and horizontally. The carrier 18 advantageously packages the individual antennas 16 into one unit for convenient installation. The carrier 18 is preferably made of sheet metal, comprising vertical members 26 joined at the top and bottom with formed sheet metal box structure 28, which includes sidewalls 30 and bottom wall 32. The vertical members 26 are attached to the sidewalls 30 with standard hardware, such as nut and bolt 34. Printed circuit boards 36, each containing four antennas 16, one for each of the four levels, are attached to the respective vertical members 26 with plastic spacers 38. The splitters 22, which are implemented on printed circuit boards, are disposed at each level and are connected to the four antennas 16 at that level. A handle 40 is attached to the upper box structure 28 for convenient handling of the antenna system 14 during installation. Cables 42, one from each splitter 22, are connected to the access point 24. The coaxial cables 42 are routed down the inside of the housing 4 of the bollard light fixture to the communication device (access point, cellular or LTE radios and modems, etc.). The communication device can be located inside of the bollard light fixture if there is room or outside.

Figure 8:
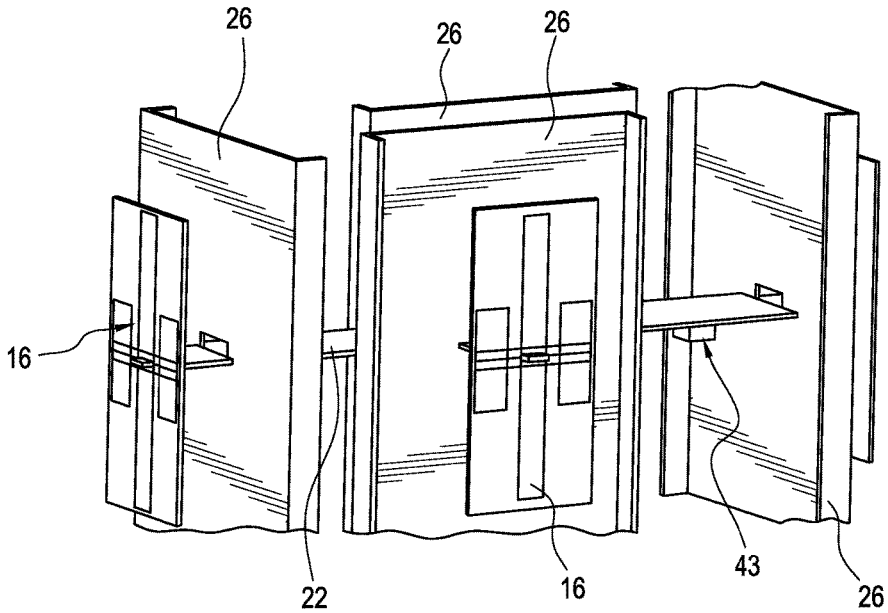
FIG. 8 is a perspective view of one level of antennas with the associated splitter.
Figure 9:
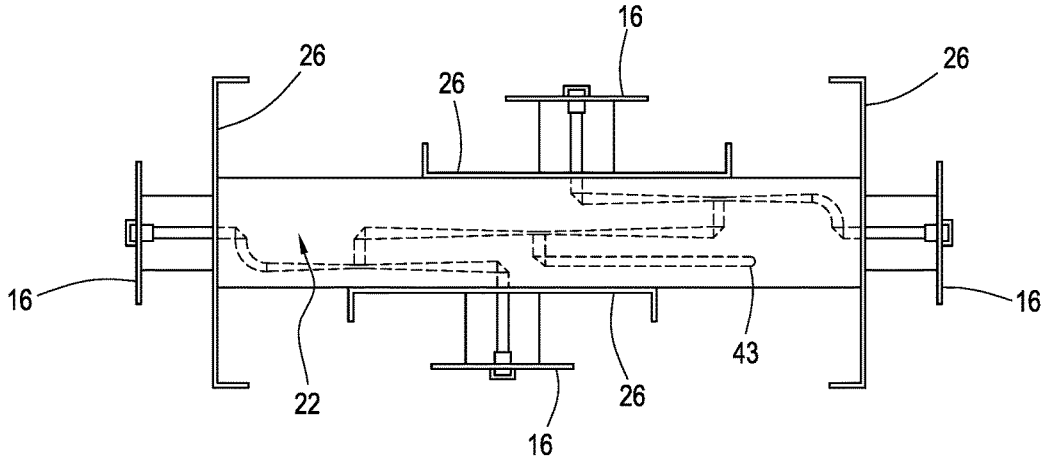
FIG. 9 is a schematic bottom view of four antennas in one level of the antenna system shown in FIG. 6

Referring to FIGS. 8 and 9, the antennas 16 at one level are shown connected to the splitter 22 for that level to provide one output connector 43 to which a coaxial cable 42 is connected, which is then connected to the access point 24. Each of the four antennas 16 on the respective level is connected to the respective splitter 22, which is preferably an equal power, equal phase low loss power splitter. The connector 43 on the splitter 22 is connected to a coaxial cable 42, which is connected to the access point. The connectors at the end of the coaxial cable that connects to the access point 24 can be reverse polarity TNC (RPTNC), reverse polarity SMA (RPSMA) or N Type. This embodiment of the bollard lighting fixture consists of 16 antennas for one 4-port access point. The quasi-omnidirectional configuration advantageously allows for greater isolation between the four ports of the access point.

Figure 10:
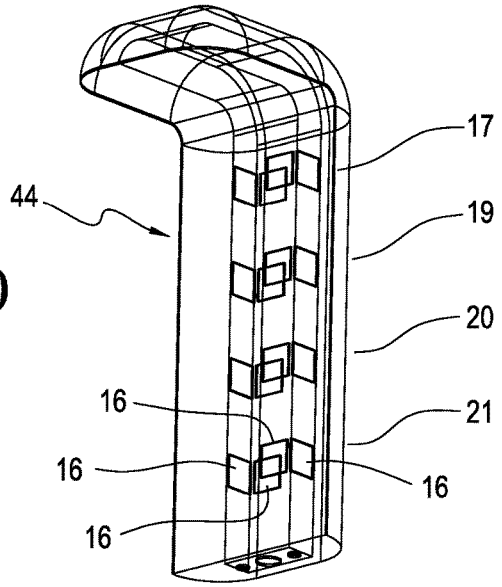
FIG. 10 is schematic perspective view of a bollard light fixture showing a plurality of directional antennas inside the housing of the bollard light fixture.
Figure 11:
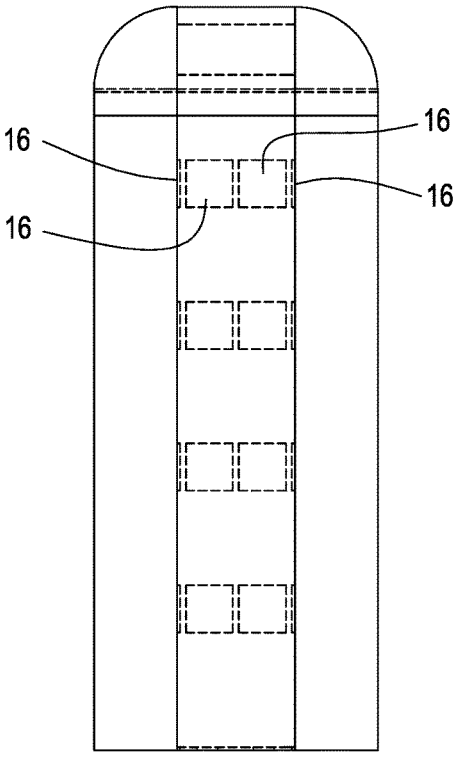
FIG. 11 is a front view of FIG. 10.
Figure 12:
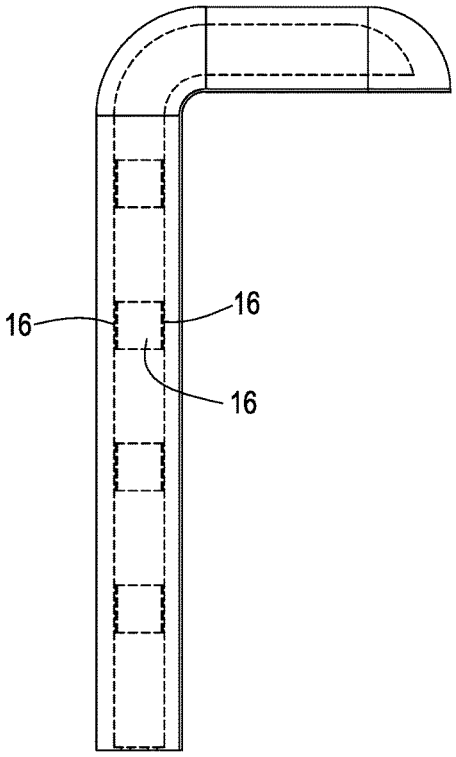
FIG. 12 is side view of FIG. 11.

Referring to FIGS. 10-12, the four levels 17, 19, 20 and 21 of the antennas 16 are schematically shown inside a bollard light fixture 44. The carrier 18 is not shown for simplicity. Each of the four antennas 16 at each level is pointed to the respective four directions of the X- and Y-axes to provide a quasi-omnidirectional coverage.

Figure 13:
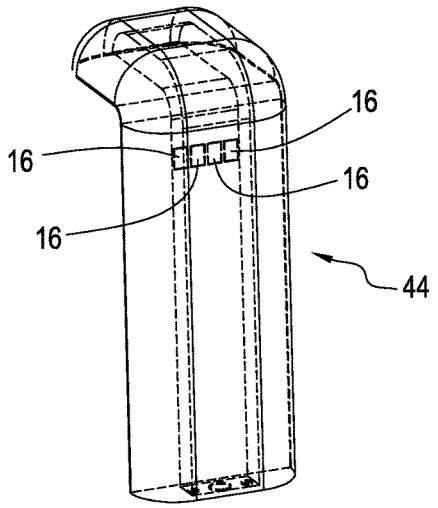
FIG. 13 is a schematic perspective view of a bollard light fixture showing a plurality of directional antennas inside the housing of the bollard light fixture.
Figure 14:
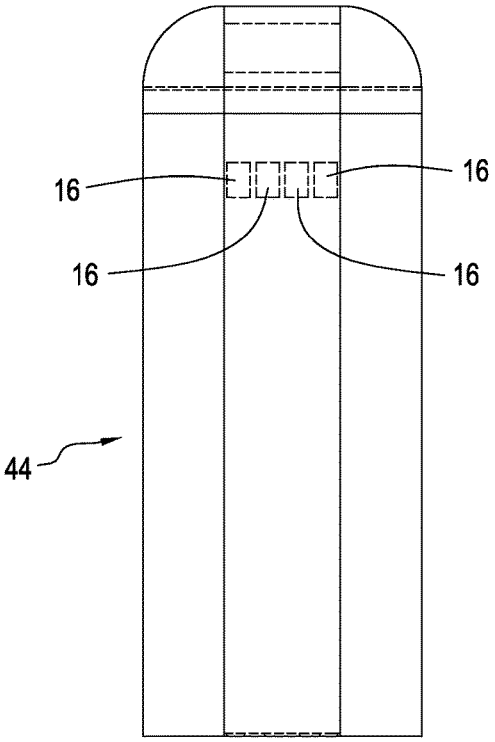
FIG. 14 is front view of a bollard light fixture shown in FIG. 13.
Figure 15:
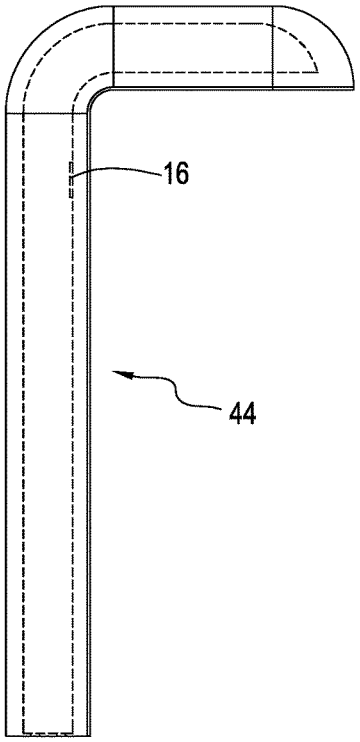
FIG. 15 is side view of FIG. 14.

Referring to FIGS. 13-15, four directional antennas 16 are shown schematically inside the bollard light fixture 44. The antennas 16 radiate in only one direction. In this embodiment, each of the antennas 16 connects to a 4-port access point. The four antennas 16 are placed side-to-side inside on the front face of the bollard light fixture housing. Each antenna 16 is connected to a coaxial cable and the opposite end of the coaxial cable is connected to the 4 ports of the access point.

The connectors at the end of the coaxial cable that connects to the access point can be reverse polarity TNC (RPTNC), reverse polarity SMA (RPSMA) or N Type.

Figure 16:
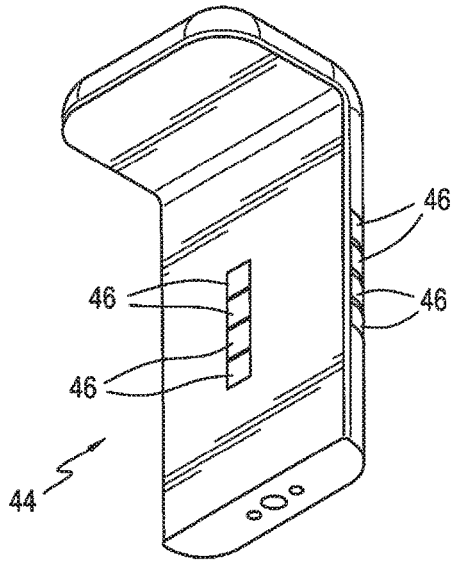
FIG. 16 is a perspective view of a bollard light fixture with windows provided on four sides of the housing of the bollard light fixture.
Figure 17:
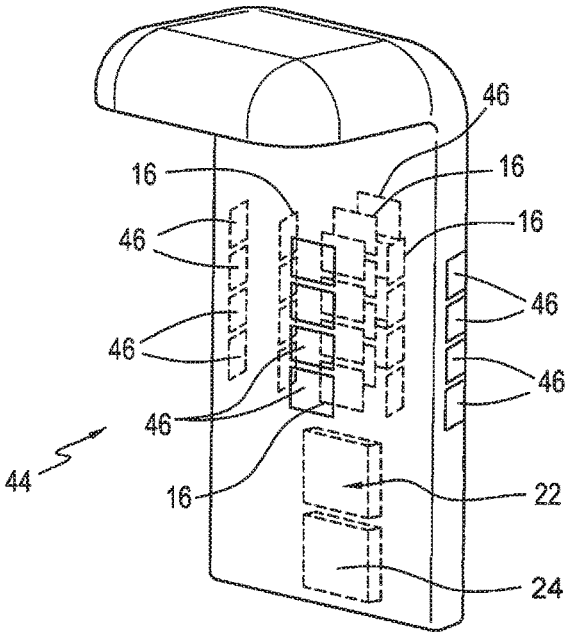
FIG. 17 is a schematic view of the plurality of antennas inside the bollard light fixture showing the antennas aligned with respective windows in the housing.

Referring to FIGS. 16-17, the bollard light fixture 44 is shown with windows 46 provided on each of the four sides of the housing. In this embodiment, the windows 46 are cut out of the material the bollard light fixture housing is manufactured out of and covered with material that allows the antennas 16 to radiate out of housing of the bollard light fixture. The material of the windows 46 is commonly referred to as "RF friendly" and could be plastic, glass, etc. Windows 46 are used when the housing of the bollard light fixture interferes or blocks the transmission of RF radiation. Each window 46 is aligned with a respective antenna 16. The four-to-one splitter 22 and the access point 24 are disposed inside the bollard light fixture.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A bollard light fixture, comprising:

a) a bollard housing including a vertical hollow portion;

b) a plurality of antennas disposed within the vertical hollow portion, the plurality of antennas are configured to propagate RF signal to a user's device and to receive RF signal from the user's device c) the plurality of antennas are grouped into vertical levels, the antennas at each level are directed toward X- and Y-axes directions.

2. The bollard light fixture as in claim 1, wherein:

a) the antennas in each vertical level are connected to a four-to-one splitter; and b) an access point connected to the four-to-one splitter.

3. The bollard light fixture as in claim 2, wherein the plurality of antennas are arranged in four vertical levels.

4. The bollard light fixture as in claim 1, wherein:

a) the plurality of antennas are operably attached to a carrier disposed inside the housing;

b) the carrier includes first, second, third and fourth vertical members spaced apart from each other and disposed transverse to the respective directions of the X- and Y-axes; and c) the plurality of antennas are operably attached to the respective first, second, third and fourth vertical members.

5. The bollard light fixture as in claim 4, and further comprising:

a) first, second, third and fourth printed circuit boards operably attached to the respective first, second, third and fourth vertical members; and b) the plurality of antennas are disposed on the respective first, second, third and fourth printed circuit boards, each antenna corresponding to the respective directions in the X- and Y-axes at each level.

6. The bollard light fixture as in claim 5, wherein each level includes four antennas, each of the four antennas being directed to the respective X- and Y-axes directions.

7. The bollard light fixture as in claim 1, wherein:

a) the housing includes windows aligned respectively with the plurality of antennas; and b) the windows are made of a material that allows RF signals to pass through.

8. The bollard light fixture as in claim 1, wherein:

a) the housing is an inverted L-shape including the vertical hollow portion and an upper horizontal portion; and b) a light source is disposed at the upper horizontal portion.

9. The bollard light fixture as in claim 1, and further comprising an access point operably connected to the plurality of antennas.

10. The bollard light fixture as in claim 9, wherein the access point is disposed within the housing.

11. A bollard light fixture, comprising:

a) a bollard housing including a vertical hollow portion;

b) a plurality of directional antennas disposed within the vertical hollow portion, the plurality of antennas are configured to propagate RF signal to a user's device and to receive RF signal from the user's device;

c) the plurality of directional antennas are operably attached to a carrier disposed inside the housing, the carrier including first, second, third and fourth vertical members spaced apart from each other and disposed transverse to respective X- and Y-axes directions; and d) the plurality of directional antennas are operably attached to the respective first, second, third and fourth vertical members.

12. A bollard light fixture, comprising:

a) a bollard housing having a vertical hollow portion;

b) an antenna disposed within the vertical hollow portion, the antenna is configured to propagate RF signal to a user's device and to receive RF signal from the user's device;

c) an access point disposed inside the housing and operably connected to the antenna to provide wireless connection to the user's device;

d) a carrier disposed inside the housing;

e) the antenna is operably attached to the carrier;

f) the antenna is an omnidirectional antenna and includes first, second, third and fourth directional antennas;

g) the carrier includes first, second, third and fourth vertical members spaced apart from each other and disposed transverse to respective X- and Y-axes directions; and h) the first, second, third and fourth directional antennas are operably attached to the first, second, third and fourth vertical members, respectively.

13. The bollard light fixture as in claim 12, and further comprising:

a) first, second, third and fourth printed circuit boards;

b) the first, second, third and fourth directional antennas are disposed on the first, second, third and fourth printed circuit boards, respectively; and c) the first, second, third and fourth printed circuit boards are operably attached to the first, second, third and fourth vertical members, respectively.

* * * * *